US010971852B2

(12) United States Patent
Fukatsu et al.

(10) Patent No.: US 10,971,852 B2
(45) Date of Patent: Apr. 6, 2021

(54) TWO CONNECTORS ELECTRO-MECHANICALLY JOINED BY A BUSBAR

(71) Applicant: Sumitomo Wiring Systems, Ltd., Mie (JP)

(72) Inventors: Yukihiro Fukatsu, Mie (JP); Toshikazu Sakurai, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/722,129

(22) Filed: Dec. 20, 2019

(65) Prior Publication Data

US 2020/0212619 A1 Jul. 2, 2020

(30) Foreign Application Priority Data

Dec. 28, 2018 (JP) ..... JP2018-246637

(51) Int. Cl.
*H01R 13/514* (2006.01)
*H01R 13/631* (2006.01)

(52) U.S. Cl.
CPC ..... *H01R 13/514* (2013.01); *H01R 13/631* (2013.01)

(58) Field of Classification Search
CPC ..... H01R 31/08; H01R 31/085; H01R 11/01; H01R 4/00
See application file for complete search history.

(56) References Cited

FOREIGN PATENT DOCUMENTS

| | | | | |
|---|---|---|---|---|
| JP | 07-161419 | | 6/1995 | |
| JP | 9237668 A | * | 9/1997 | ..... H01R 31/08 |

* cited by examiner

*Primary Examiner* — Vanessa Girardi
(74) *Attorney, Agent, or Firm* — Gerald E. Hespos; Michael J. Porco; Matthew T. Hespos

(57) ABSTRACT

It is aimed to provide a joint connector capable of holding a plurality of housings and a busbar without complicating the entire configuration. A joint connector includes a first housing (10) configured to accommodate first terminals (60), a second housing (40) configured to accommodate second terminals (70) and be united with the first housing (10), and a busbar (80) having first tabs (84) to be connected to the first terminals (60) and second tabs (85) to be connected to the second terminals (70). The busbar (80) includes a coupling portion (83) coupling the side of the first tabs 84 and the side of the second tabs (85), first fixing portions (86) to be fixed to the first housing (10) and second fixing portions (87) to be fixed to the second housing (40).

5 Claims, 5 Drawing Sheets

TWO CONNECTORS ELECTRO-MECHANICALLY JOINED BY A BUSBAR

BACKGROUND

Field of the Invention

The invention relates to a joint connector.

Related Art

Japanese Unexamined Patent Publication No. H07-161419 discloses a joint connector with a housing for grounding, a connector housing and a busbar. A ground connection terminal is accommodated in the housing for grounding. The connector housing includes a terminal accommodating portion for accommodating a connection terminal and a ground terminal holding portion for holding the housing for grounding. The busbar includes a fixing plate projecting to the outside of the connector housing and to be fixed to a vehicle body, a tab terminal to be connected to the connection terminal and a ground connection tab terminal to be connected to the ground connection terminal. The tab terminal and the ground connection tab terminal project in parallel on the fixing plate. The connection terminal is accommodated in the terminal accommodating portion, the housing for grounding is held in the ground terminal holding portion and the connection terminal and the ground connection terminal are connected respectively to the tab terminal and the ground connection tab terminal. Thus, the connection terminal and the ground connection terminal are jointed (short-circuited) via the busbar.

A hinged lid is integral to the connector housing to prevent separation of the busbar from the connector housing. Further, the connector housing has an engaging piece, and the housing for grounding has a locking arm with a locking projection that locks the engaging piece to prevent separation of the housing for grounding from the connector housing. Thus, there is a concern that the entire configuration becomes complicated and costly.

The invention was completed on the basis of the above situation and aims to provide a joint connector capable of holding housings and a busbar without complicating the configuration.

SUMMARY

The invention is directed to a joint connector with a first housing to accommodate a first terminal, a second housing to accommodate a second terminal and to be united with the first housing, and a busbar including a first tab to be connected to the first terminal and a second tab to be connected to the second terminal. The busbar includes a coupling to couple the first tab side and the second tab side, a first fixing portion to be fixed to the first housing and a second fixing portion to be fixed to the second housing.

With this configuration, the first terminal and the second terminal are jointed via the busbar. Further, the first fixing portion is fixed to the first housing and the second fixing portion is fixed to the second housing. Thus, the first housing and the second housing are held coupled via the busbar. A joint function and a holding function are consolidated on the busbar and it is not necessary to provide a fixing structure for holding the first housing and the second housing in a coupled state or a simple fixing structure can be employed. Thus, the entire configuration is not complicated.

The busbar may be accommodated in the first housing. Thus, a dedicated relay housing or the like for accommodating the busbar is unnecessary, the number of components can be reduced and the entire configuration is simplified.

The busbar may be movable to a temporarily fixed position and a completely fixed position with respect to the first housing. The first fixing portion may be fixed to the first housing at least at the completely fixed position, and the first tab may be in contact with the first terminal with a contact pressure lower than a proper contact pressure at the completely fixed position or may not contact the first terminal when the busbar is at the temporarily fixed position. If the first terminal interferes with a lock, such as a locking lance of the first housing, to generate interference resistance and further contacts the first tab of the busbar to generate contact resistance at the time of mounting the first terminal, it may not be possible to proceed smoothly. However, the above configuration mounts the first terminal into the first housing when the busbar at the temporarily fixed position. Thus, the first tab can contact the first terminal with a low contact pressure or does not contact the first terminal. Accordingly, a large contact resistance is not generated between the first terminal and the busbar, and work efficiency at the time of mounting the first terminal can be improved.

DETAILED DESCRIPTION

First Embodiment

Figure 1:
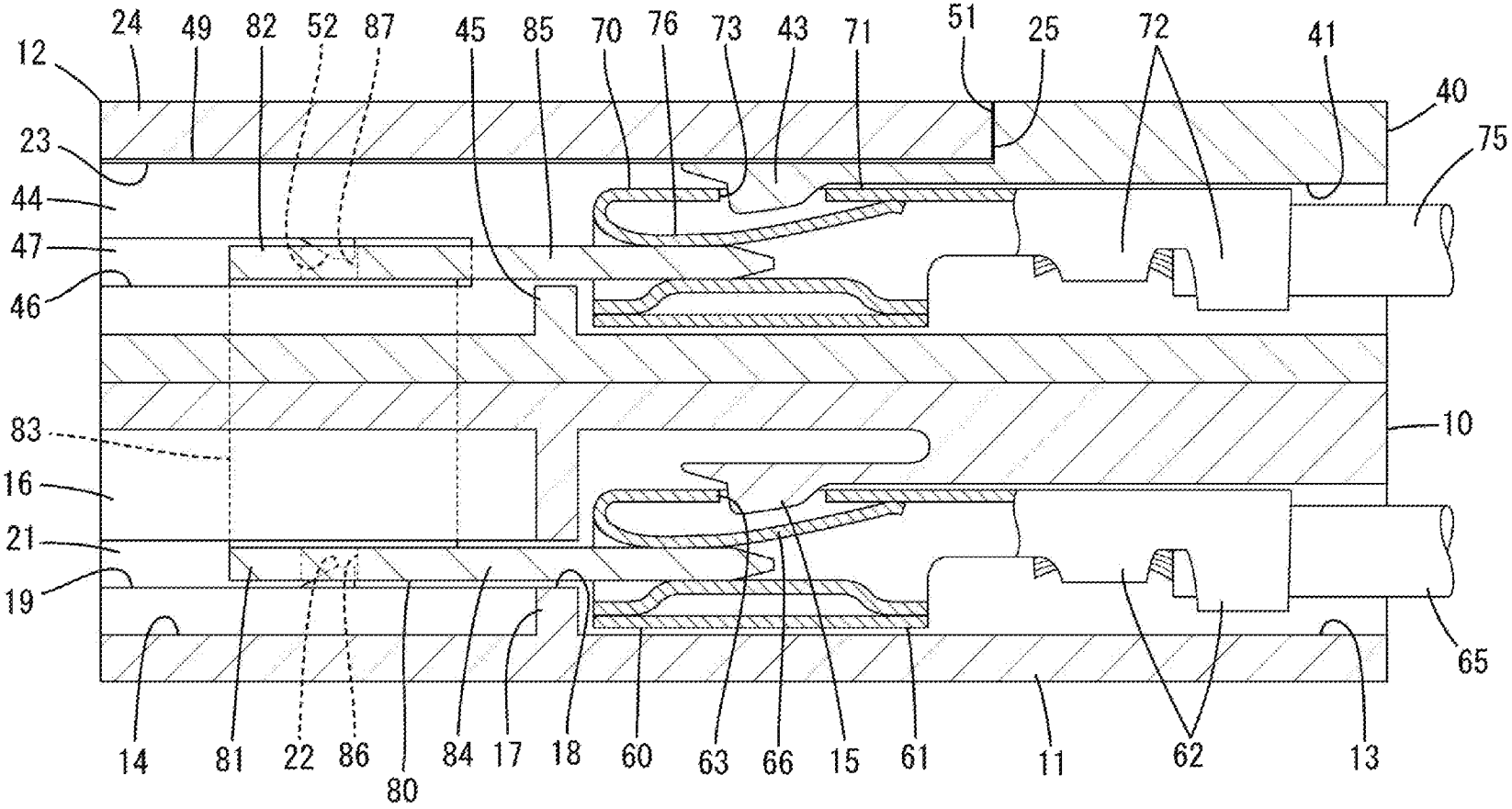
FIG. 1 is a section of a joint connector according to a first embodiment of the invention.

A first embodiment of the invention is described with reference to FIGS. 1 to 4. A joint connector according to this embodiment includes a first housing 10, a second housing 40, first terminals 60, second terminals 70 and a busbar 80.

[First Housing 10]

Figure 2:
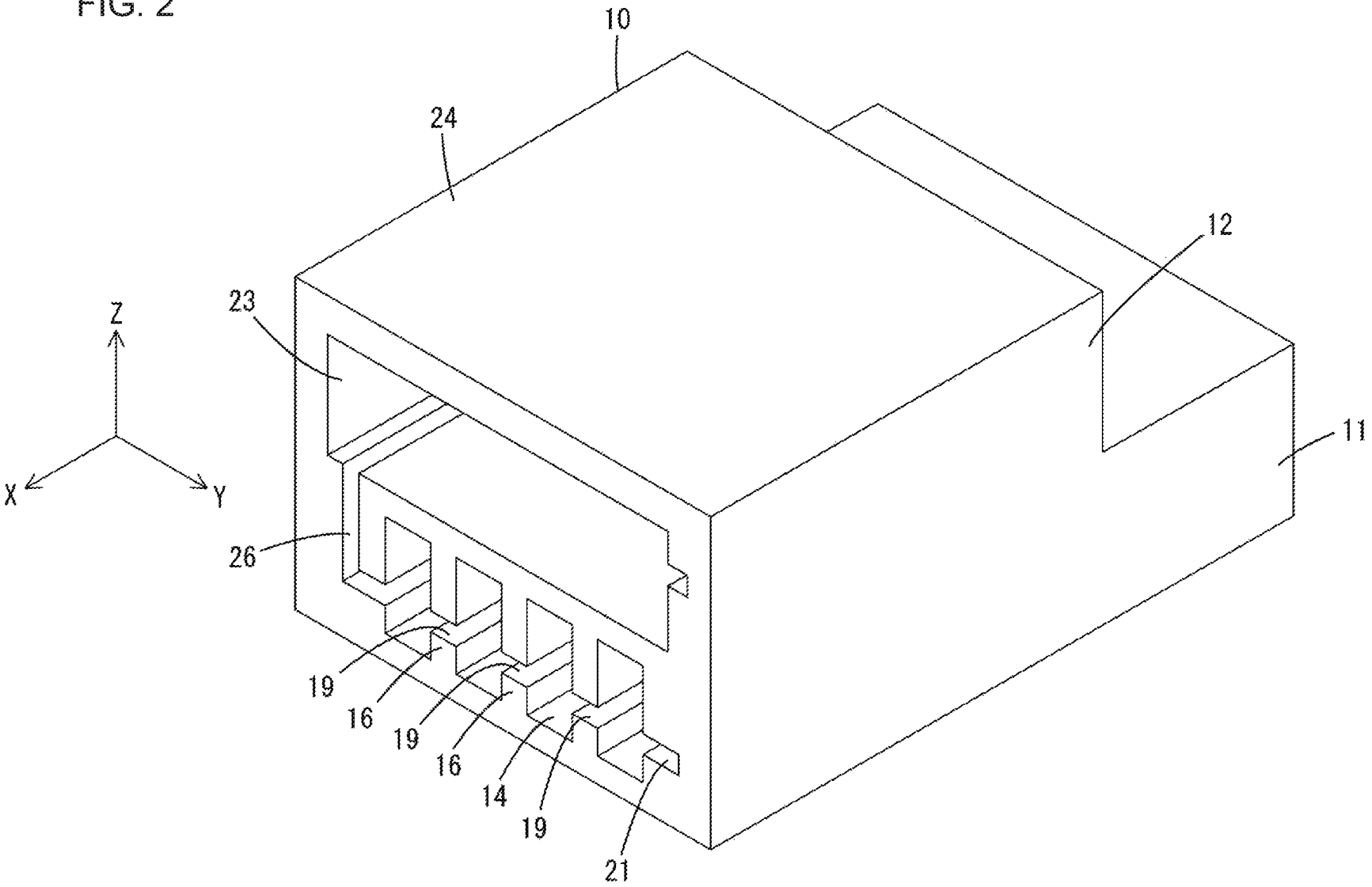
FIG. 2 is a perspective view of a first housing.

The first housing 10 is made of synthetic resin and includes, as shown in FIG. 2, a housing body 11 arranged in a lower stage in a vertical direction (Z direction of FIG. 2) and an accommodating portion 12 arranged in an upper stage and integrally connected to the housing body 11. As shown in FIG. 1, the housing body 11 includes first cavities 13 (only one is shown in FIG. 1) capable of accommodating the first terminals 60 in a rear part, and one first busbar accommodation space 14 capable of accommodating a later-described first body 81 of the busbar 80 in a front part.

The first cavities 13 extend in a front-rear direction (X direction of FIG. 2), are open in the rear surface of the housing body 11 and are arranged in a row in a width direction (Y direction of FIG. 2). Each first cavity 13 includes a deformable first locking lance 15 projecting forward on an upper or lower surface (upper surface in a shown case) as shown in FIG. 1. The first cavities 13 that are adjacent in the width direction are partitioned by first separation walls 16. Each first separation wall 16 is arranged over the entire length of the first housing 10 and also in the first busbar accommodation space 14, as shown in FIG. 2.

As shown in FIG. 1, the first housing 10 includes a first partition wall 17 between the front ends of the first cavities 13 and the first busbar accommodation space 14. The first partition wall 17 is formed with first insertion holes 18 penetrating at positions corresponding to the first cavities 13. Later-described first tab portions 84 of the busbar 80 are insertable into the first insertion holes 18.

As shown in FIG. 2, the first separation walls 16 partition the first busbar accommodation space 14 into plural chambers in the width direction. First cuts 19 are formed at the same heights of the first separation walls 16 on the side of the first busbar accommodation space 14. The housing body 11 includes a first mounting groove 21 in the form of a slit extending in the width direction via the respective first cuts 19 in the first busbar accommodation space 14.

As shown in FIG. 1, the housing body 11 is formed with first fixed portions 22 on the upper or lower surfaces (lower surfaces in the shown case) of the first cuts 19 of the first separation walls 16. Each first fixed portion 22 is in the form of a claw and includes a sloped part inclined rearward in a mounting direction of the busbar 80. The first fixed portion 22 can be fixed to a later-described first fixing portion 86 of the busbar 80.

As shown in FIG. 2, the accommodating portion 12 projects on a part of the upper surface of the housing body 11 excluding a rear end part. The accommodating portion 12 includes one accommodation space 23 penetrating in the front-rear direction and having a rectangular cross-section. The second housing 40 is inserted into the accommodation space 23 from behind. As shown in FIG. 1, an upper wall 24 of the accommodating portion 12 closes an opening in the upper surface of the accommodation space 23 and has a stopper surface 25 extending along the width direction on a rear end. When the second housing 40 is inserted properly into the accommodation space 23, a later-described step 51 of the second housing 40 can be stopped in contact with the stopper surface 25.

As shown in FIG. 2, the first housing 10 includes a first communication groove 26 in the form of a slit extending along the vertical direction on one widthwise side. The first communication groove 26 is formed over the accommodating portion 12 in the upper stage and the housing body 11 in the lower stage to communicate with the accommodation space 23 and the first busbar accommodation space 14 (including the first mounting groove 21).

[Second Housing 40]

Figure 3:
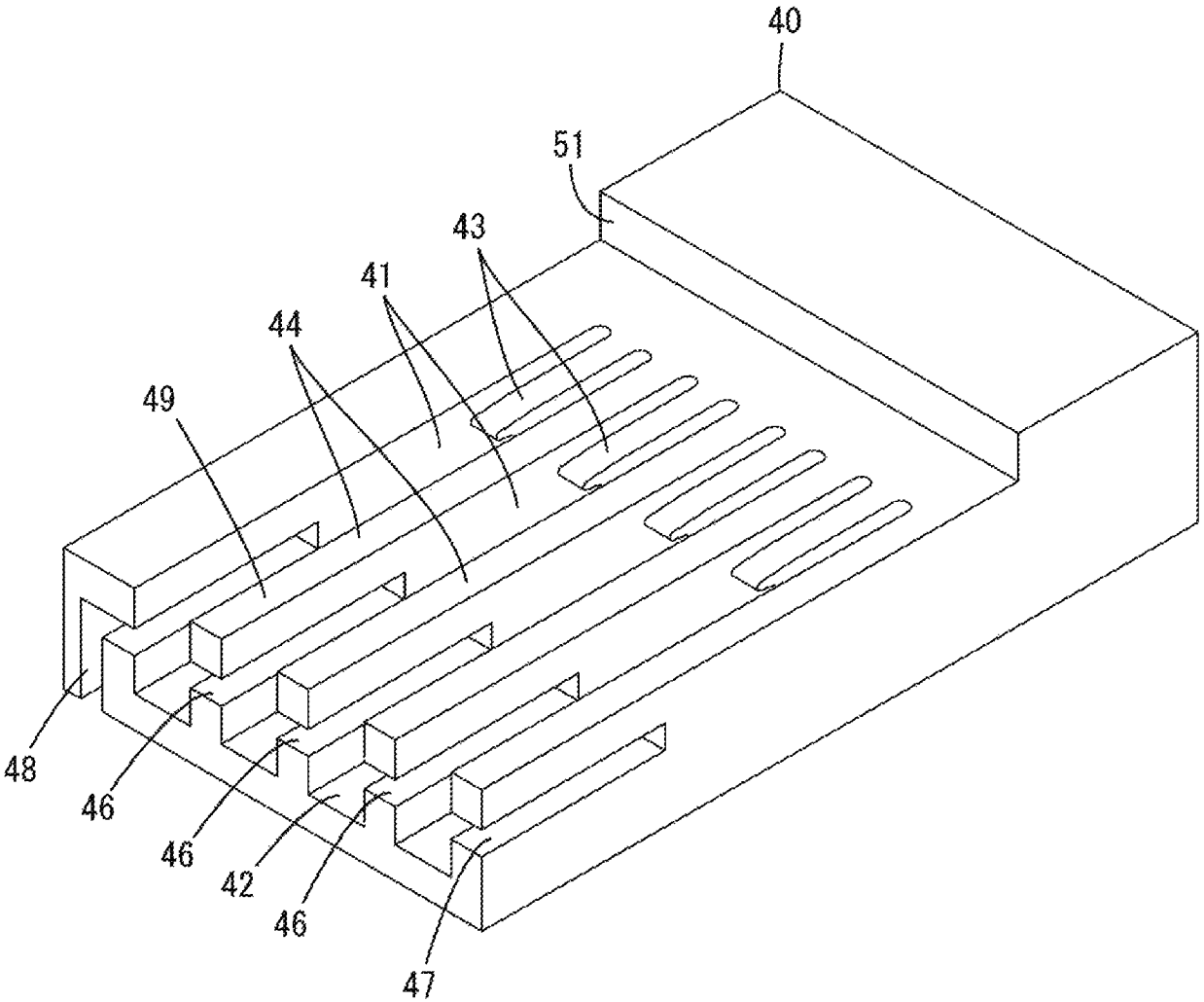
FIG. 3 is a perspective view of a second housing.

The second housing 40 is made of synthetic resin and, as shown in FIG. 3, has a flat shape extending along the width direction. A structure of the second housing 40 is similar to that of the housing body 11 and includes second cavities 41 capable of accommodating the second terminals 70 in a rear part and one second busbar accommodation space 42 capable of accommodating a later-described second body 82 of the busbar 80 in a front part.

The respective second cavities 41 extend in the front-rear direction, are open in the rear surface of the second housing 40 and are arranged in a row in the width direction. Each second cavity 41 includes a deflectable and deformable second locking lance 43 projecting forward on an upper or lower surface (upper surface in the shown case) as shown in FIG. 1. As shown in FIG. 3, the respective second cavities 41 adjacent in the width direction are partitioned by second separation walls 44. Each second separation wall 44 is arranged over the entire length of the second housing 40 and also is provided in the second busbar accommodation space 42.

As shown in FIG. 1, the second housing 40 includes a second partition wall 45 between the front ends of the second cavities 41 and the second busbar accommodation space 42. The second partition wall 45 extends along the width direction. The second partition wall 45 enables later-described second tabs 85 of the busbar 80 to be inserted from above at positions corresponding to the respective second cavities 41.

As shown in FIG. 3, the second busbar accommodation space 42 is partitioned into chambers in the width direction by the second separation walls 44. Second cuts 46 are formed at the same height positions of the respective second separation walls 44 on the side of the second busbar accommodation space 42. The second housing 40 includes a second mounting groove 47 in the form of a slit extending in the width direction via the respective second cuts 46 in the second busbar accommodation space 42. The second housing 40 includes a second communication groove 48 extending in the vertical direction on one widthwise side and having a lower end open in the lower surface of the second housing 40 and an upper end communicating with the second mounting groove 47. The second mounting groove 47 is open in the other widthwise end surface of the second housing 40 on a side opposite to the widthwise side communicating with the second communication groove 48.

As shown in FIG. 3, the upper surface of the second housing 40 has an exposed surface 49 in an area excluding a rear end part. In the exposed surface 49, the second busbar accommodation space 42 and the respective second cavities 41 are open and the upper ends of the second separation walls 44 and the second locking lances 43 are exposed. The rear end part of the upper surface of the second housing 40 is slightly higher than the exposed surface 49 and a part thereof connected to the exposed surface 49 serves as the step 51 facing forward. The step 51 is provided over the entire width of the second housing 40.

The second housing 40 is provided with second fixed portions 52 on the upper or lower surfaces (upper surfaces in the shown case) of the second cuts 46 of the second separation walls 44. The second fixed portion 52 is a claw and includes a sloped part inclined rearward in the mounting direction of the busbar 80. The second fixed portion 52 can be fixed to a later-described second fixing portion 87 of the busbar 80 (see FIG. 1).

[First Terminals 60 and Second Terminals 70]

Each of the first terminals 60 and the second terminals 70 is formed, such as by bending a conductive metal plate, and a number of the first terminals 60 corresponding to the respective first cavities 13 and a number of the second terminals 70 corresponding to the respective second cavities 41 are provided. As shown in FIG. 1, the first terminals 60 and the second terminals 70 are of the same shape and size.

Each of the first and second terminals 60 and 70 is formed integrally, such as by bending the conductive metal plate and includes, as shown in FIG. 1, a rectangular tubular connecting portion 61, 71 and an open barrel 62, 72 provided behind the connecting portion 61, 71. The connecting portion 61, 71 is provided with a lance receiving portion 63, 73. The barrel 62, 72 is crimped and connected to an end part of a wire 65, 75. A deflectable and deformable contact portion 66, 76 is provided in the connecting portion 61, 71. The first tab 84 is inserted into the connecting portion 61 of the first terminal 60 and the contact portion 66 resiliently contacts the first tab 84 so that the first terminal 60 and the busbar 80 are connected electrically. Similarly, the second tab 85 is inserted into the connecting portion 71 of the second terminal 70 and the contact portion 76 resiliently contacts the second tab 85 so that the second terminal 70 and the busbar 80 are electrically connected.

[Busbar 80]

Figure 4:
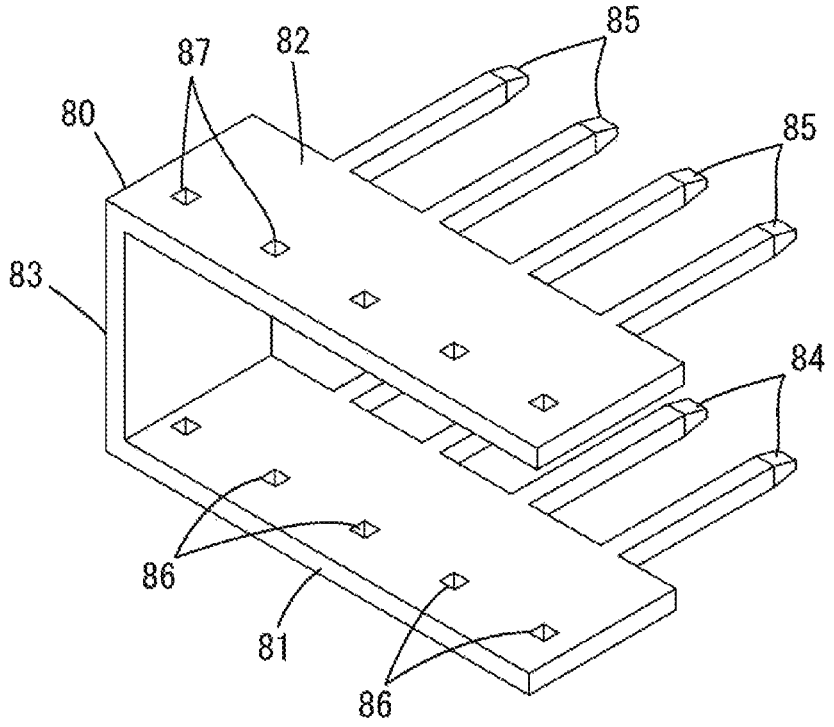
FIG. 4 is a perspective view of a busbar.

The busbar 80 is formed, such as by bending a conductive metal plate and includes, as shown in FIG. 4, the strip-like first body 81 arranged along the width direction, the strip-like second body 82 arranged above and in parallel to the first body 81 and a coupling 83 extending vertically and having a lower end connected at a right angle to one widthwise end of the first body 81 and an upper end connected at a right angle to one widthwise end of the second body 82. The first body 81, the coupling 83 and the second body 82 have the same width in the front-rear direction and are continuous to form an angular C shape.

Further, the busbar 80 includes the first tabs 84 projecting in a comb-tooth manner from the rear end of the first body 81 and the second tabs 85 likewise projecting in a comb-tooth manner from the rear end of the second body 82. The first tabs 84 and the second tabs 85 are arranged at the same intervals in parallel in the width direction to face each other in the first and second bodies 81, 82.

First fixing portions 86 are provided between the first tabs 84 and at outer sides of the first tabs 84 on both ends in the width direction in a front part of the first body 81. Each first fixing portion 86 is a rectangular hole penetrating through the first body 81 in a plate thickness direction and, as shown in FIG. 1, can fit to the corresponding first fixed portion 22. Similarly, second fixing portions 87 are provided between the respective second tabs 85 and at outer sides of second tabs 85 on both ends in the width direction in a front part of the second body 82. Each second fixing portion 87 is a rectangular hole penetrating through the second body 82 in a plate thickness direction and, as shown in FIG. 1, can fit to the corresponding second fixed portion 52. As shown in FIG. 4, the first fixing portions 86 and the second fixing portions 87 are arranged at the same intervals in parallel in the width direction to face each other in the first and second bodies 81, 82.

[Assembling Method]

In assembling, the busbar 80 is mounted into the housing body 11 of the first housing 10. The first body 81 is inserted into the first mounting groove 21 of the first busbar accommodation space 14 from the front, a lower part of the coupling 83 is inserted into the first communication groove 26 from the front, and the respective first fixed portions 22 are fit resiliently into the respective first fixing portions 86 so that the busbar 80 is held retained in the first housing 10. At this time, the respective first tabs 84 are arranged to project into the respective first cavities 13 through the respective first insertion holes 18.

Subsequently, each first terminal 60 is inserted into each first cavity 13. Each first terminal 60 is held in the first housing 10 by a tip part of the first locking lance 15 being fit into the lance receiving portion 63. Further, each first tab 84 is inserted into the connecting portion 61 of each first terminal 60 and resiliently contacts the contact portion 66. Note that, conversely to the above, the busbar 80 may be mounted into the housing body 11 after each first terminal 60 is inserted into each first cavity 13.

The second housing 40 is inserted into the accommodation space 23 of the accommodating portion 12 of the first housing 10 from behind with the respective second terminals 70 mounted therein in advance. In the process of inserting the second housing 40, the second body 82 is inserted into the second mounting groove 47 of the second busbar accommodation space 42 from the front and an upper part of the coupling 83 is inserted into the second communication groove 48 from the front. Thereafter, the respective second fixing portions 87 are fit resiliently into the respective second fixed portions 52 so that the second housing 40 is held in the first housing 10 via the busbar 80. Further, the step 51 of the second housing 40 is arranged to be stopped in contact with the stopper surface 25 of the accommodating portion 12, thereby restricting further insertion of the second housing 40. The exposed surface 49 of the second housing 40 is covered by the upper wall 24 of the accommodating portion 12 to protect the respective second locking lances 43.

When the second housing 40 is inserted properly into the accommodation space 23, the second tabs 85 are inserted into the connecting portions 71 of the respective second terminals 70 and resiliently contact the contact portions 76. In this way, the first terminals 60 and the respective second terminals 70 are jointed (short-circuited) via the busbar 80.

As described above, according to the first embodiment, the busbar 80 and the first housing 10 are held (fixed) to each other by the respective first fixing portions 86 fixing the respective first fixed portions 22, and the busbar 80 and the second housing 40 are held (fixed) to each other by the respective second fixing portions 87 fixing the respective second fixed portions 52. As a result, the first housing 10 and the second housing 40 are held coupled via the busbar 80. As a result, a locking structure or the like for coupling and holding the first housing 10 and the second housing 40 can be omitted and the entire configuration becomes less complicated.

Further, since the busbar 80 is accommodated into the first housing 10 and the second housing 40 is fit to be united with the first housing 10, a dedicated relay housing or the like for accommodating the busbar 80 is unnecessary and the number of components can be reduced. As a result, the entire configuration can be more simplified.

Second Embodiment

Figure 5:
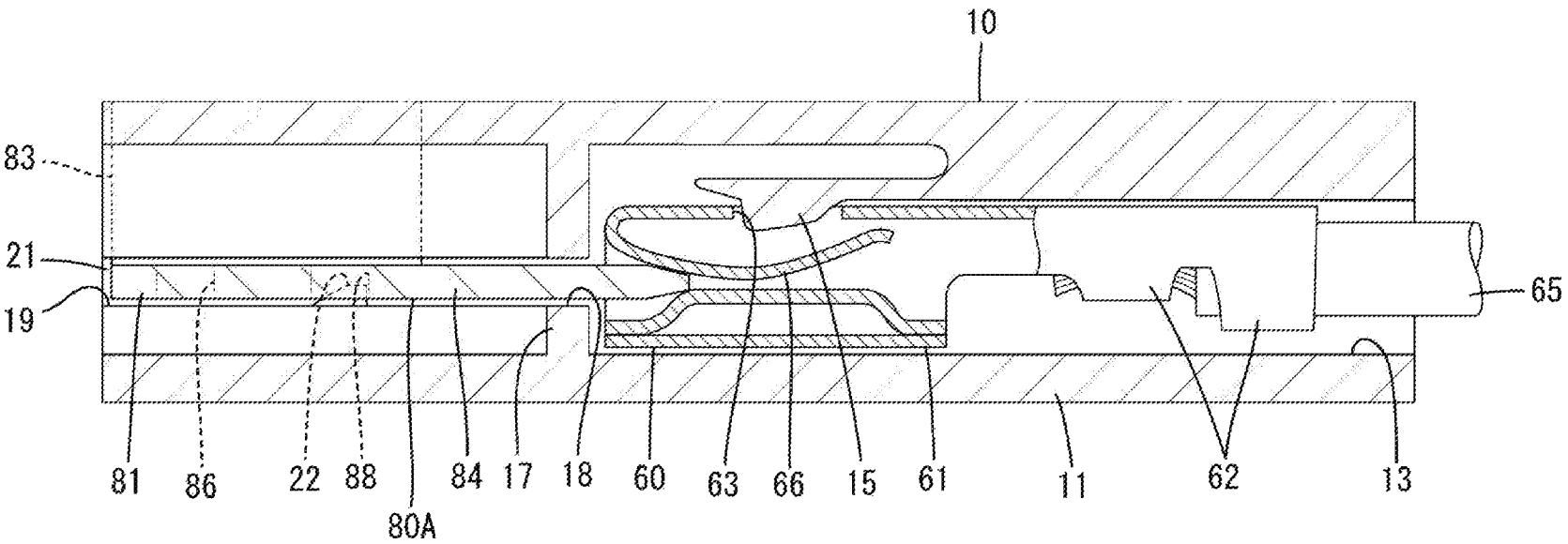
FIG. 5 is a sectional view showing a busbar held at a temporarily fixed position in a first housing and tip parts of first tabs of the busbar lightly in contact with contact portions of first terminals in a joint connector according to a second embodiment.

A second embodiment differs from the first embodiment in that a busbar 80A is mounted movably to a temporarily fixed position and a completely fixed position with respect to a first housing 10. FIG. 5 shows the second embodiment and depicts a state where the busbar 80A is arranged at the temporarily fixed position with respect to the first housing 10. Note that, in the following description, structures similar to those of the first embodiment are denoted by the same reference signs and repeated description is omitted.

The busbar 80A includes, in a first body 81, plural complete fixing portions 86 (only one is shown in FIG. 5) arranged in the width direction and plural temporary fixing portions 88 (only one is shown) likewise arranged in the width direction behind the respective complete fixing portions 86. Each complete fixing portion 86 is a rectangular hole penetrating through the first body 81 in a plate thickness direction, and is equivalent to the first fixing portion 86 of the first embodiment. Each temporary fixing portion 88 also is a rectangular hole penetrating through the first body 81 in a plate thickness direction and is arranged behind the corresponding complete fixing portion 86 on the same axis. When the busbar 80A is at the temporarily fixed position, respective first fixed portions 22 are fit and fixed to the respective temporary fixing portions 88 and tips of respective first tabs 84 are inserted lightly into first cavities 13. On the other hand, when the busbar 88A is at the completely fixed position, the respective first fixed portions 22 are fit and fixed to the respective complete fixing portions 86 and the tips of the respective first tabs 84 are inserted deeply (to a proper depth) into the first cavities 13.

In a state where the first fixed portions 22 are fit in the respective temporary fixing portions 88 and the busbar 80A is held at the temporarily fixed position with respect to a housing body 11 of the first housing 10, each first terminal 60 is inserted into each first cavity 13. In the process of inserting each first terminal 60 into each first cavity 13, a connecting portion 61 interferes with a first locking lance 15 to deflect and deform the first locking lance 15. As the first terminal 60 is inserted properly into the first cavity 13, the resiliently returned first locking lance 15 is fit into a lance receiving portion 63 and the first terminal 60 is fixed by the first locking lance 15. With each first terminal 60 properly inserted in each first cavity 13, the tip of the first tab 84 is inserted lightly into the connecting portion 61 and lightly contacts a contact 66, but does not deflect or deform the contact 66. Thus, in inserting each first terminal 60 into each first cavity 13, only interference resistance due to the interference of the first terminal 60 and the first locking lance 15 is generated and substantial contact resistance is not generated between the contact 66 and the first tab 84. Therefore, an operation of inserting each first terminal 60 into each first cavity 13 can proceed smoothly.

After each first terminal 60 is inserted properly into each first cavity 13, the busbar 80A is pressed by a tool or the like and moved rearward toward the completely fixed position. When the busbar 80A reaches the completely fixed position, the respective first fixed portions 22 are fit into the respective complete fixing portions 86 and the busbar 80A is held properly in the first housing 10. Further, when the busbar 80A reaches the completely fixed position, the respective first tabs 84 are inserted deeply into the connecting portions 61 and maintain a state in contact with the respective contacts 66 while deflecting and deforming the respective contacts 66. Thereafter, a second housing 40 is accommodated into an accommodation space 23 of an accommodating portion 12 and respective second terminals 70 mounted in the second housing 40 contact respective second tabs 85 so that the first terminals 60 and the respective second terminals 70 are jointed via the busbar 80A as in the first embodiment.

According to the second embodiment, if each first terminal 60 is inserted into each first cavity 13 when the busbar 80A is at the temporarily fixed position, the first tab 84 merely contacts the first terminal 60 with a very small contact pressure. Therefore, substantial contact resistance is not generated between each first terminal 60 and the busbar 80A. As a result, workability at the time of mounting each first terminal 60 can be improved.

The invention is not limited to the above described and illustrated embodiments. For example, the following embodiments also are included in the scope of the invention.

The busbar may be arranged so that the first tabs and the second tabs face the inside of the first housing and the inside of the second housing without being accommodated into either one of the first and second housings.

The accommodating portion may be omitted from the first housing and the second housing may be placed to be stacked on the upper surface of the first housing.

A lock for holding the first and second housings in a coupled state may be provided.

The first and second fixing portions may respectively be on the first and second tabs.

The first and second fixing portions may be projections, such as by cutting the busbar and raising cut parts in the plate thickness direction.

In the second embodiment, the temporary fixing portions and the complete fixing portions may be in the second housing and the busbar may be have one first fixing portion.

In the second embodiment, the first tabs may not contact with the first terminals at all when the busbar is at the temporary fixed position with respect to the first housing.

The first and second terminals may be of different shapes and sizes from each other.

LIST OF REFERENCE SIGNS

10 . . . first housing
40 . . . second housing
60 . . . first terminal
70 . . . second terminal
80, 80A . . . busbar
83 . . . coupling portion
84 . . . first tab
85 . . . second tab
86 . . . first fixing portion (complete fixing portion)
87 . . . second fixing portion
88 . . . temporary fixing portion

What is claimed is:

1. A joint connector, comprising:

a first housing extending in a front to rear direction and having a housing body with a cavity open on a rear surface of the first housing and configured to accommodate a first terminal and a busbar accommodating space open on a front surface of the housing body, an accommodating portion formed integrally on the housing body and spaced therefrom in a vertical direction, the accommodating portion including an accommodating space penetrating through the accommodating portion in the front to rear direction and communicating with the busbar accommodating portion;

a second housing configured to accommodate a second terminal, the second housing accommodated in the accommodating space of the first housing from the rear; and a busbar at least partially accommodated in the busbar accommodating space from the front and including first and second bodies spaced apart in the vertical direction and connected to each other by a coupling portion, a first tab formed on the first body and connected to the first terminal and a second tab formed on the second body and connected to the second terminal, and a first fixing portion formed on the first body and fixed to the first housing, and a second fixing portion formed on the second body and fixed to the second housing.

2. The joint connector of claim 1, wherein the busbar is movable to a temporarily fixed position and a completely fixed position with respect to the first housing, the first fixing portion is fixed to the first housing at least at the completely fixed position, and the first tab is in contact with the first terminal with a contact pressure lower than a proper contact pressure at the completely fixed position or does not contact the first terminal when the busbar is at the temporarily fixed position.

3. The joint connector of claim 1, further comprising at least one partition wall formed in the first housing to partition the cavity from the busbar accommodating space, an insertion hole formed in the partition wall, and the first tab of the busbar penetrating through the insertion hole.

4. The joint connector of claim 1, further comprising a communication groove extending in the vertical direction between the accommodating space and the busbar accommodating space.

5. The joint connector of claim 4, wherein the busbar is arranged in the first housing with the coupling portion in the communication groove, the first body in the busbar accommodating space and the second body in the second housing accommodating space.

* * * * *